US005291760A

United States Patent [19]

Schrader

[11] Patent Number: 5,291,760

[45] Date of Patent: Mar. 8, 1994

[54] LOCK FOR DOORS

[76] Inventor: Anthony Schrader, 520 Oxford Rd., Havertown, Pa. 19083

[21] Appl. No.: 935,706

[22] Filed: Aug. 25, 1992

[51] Int. Cl.[5] ..... E05C 19/18

[52] U.S. Cl. ..... 70/14; 70/101; 70/129; 292/288; 292/289

[58] Field of Search ..... 70/14, 101, 105, 104, 70/129; 292/288-298, 205

[56] References Cited

U.S. PATENT DOCUMENTS

| | | | |
|---|---|---|---|
| 463,361 | 11/1891 | Frazier | 70/14 |
| 974,430 | 11/1910 | Rank | 292/205 |
| 1,485,207 | 2/1924 | Accetta | 70/14 |
| 2,794,663 | 6/1957 | Grodt et al. | 292/205 X |
| 3,181,319 | 5/1965 | Hudon | 70/14 |
| 3,711,894 | 1/1973 | Walters | 70/91 X |
| 3,961,816 | 6/1976 | Mueller | 70/14 X |
| 3,997,206 | 12/1976 | Hagopian | 292/290 |
| 4,052,032 | 10/1977 | Lovisa et al. | 411/435 X |
| 4,059,299 | 11/1977 | Huntley | 70/14 X |
| 4,169,619 | 10/1979 | McCracken | 292/296 X |
| 4,307,904 | 12/1981 | Daus | 70/129 X |
| 4,326,394 | 4/1982 | Stein | 70/14 |
| 4,399,672 | 8/1983 | Moorhouse | 70/101 |

FOREIGN PATENT DOCUMENTS

| | | | |
|---|---|---|---|
| 1185078 | 3/1970 | United Kingdom | 70/14 |

*Primary Examiner*—Lloyd A. Gall

*Attorney, Agent, or Firm*—Caesar, Rivise, Bernstein, Cohen & Pokotilow, Ltd.

[57] ABSTRACT

A portable lock for doors, intended for use at hospitals, nursing homes, or other institutions, whose rooms do not have a lock when they are occupied by patients or other occupants. The lock has a unitary plate upon which is mounted a clamping mechanism for attachment to the door and a locking mechanism. The lock can be manually attached and removed from the door without the use of tools and is independent of the doorknob or handle assembly and the associated keeper. In one embodiment, a key is used to unlock the door, and in another embodiment, a padlock or combination lock, and/or a tamper proof seal can be used to lock the door.

14 Claims, 3 Drawing Sheets

FIG. 1
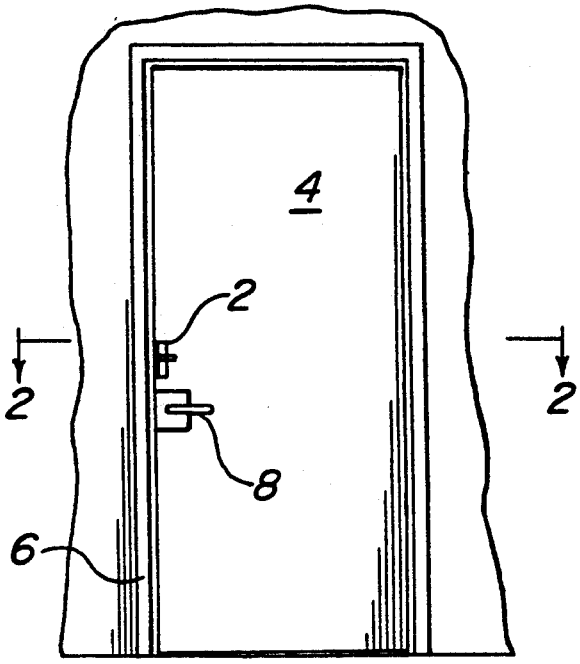
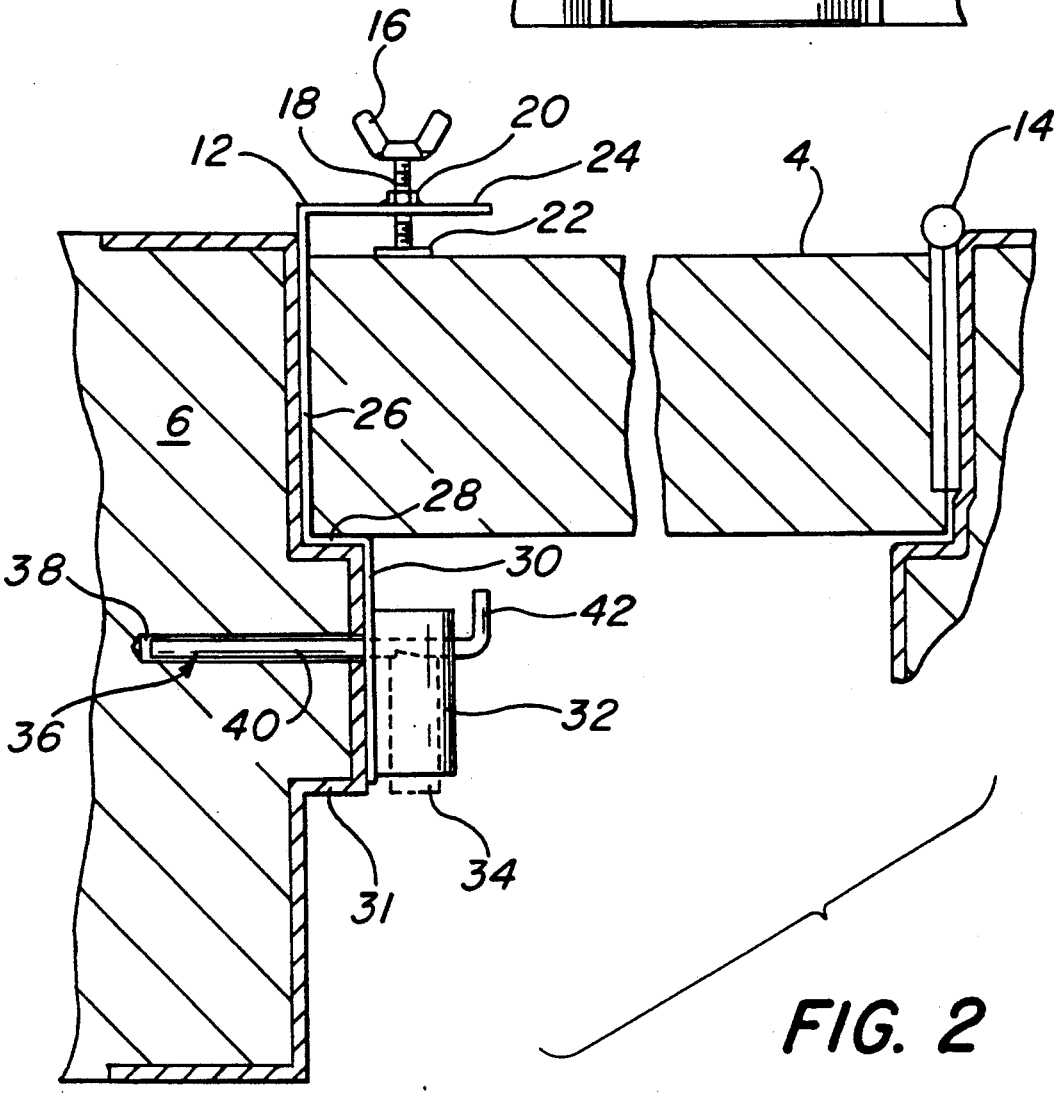
FIG. 2

FIG. 3
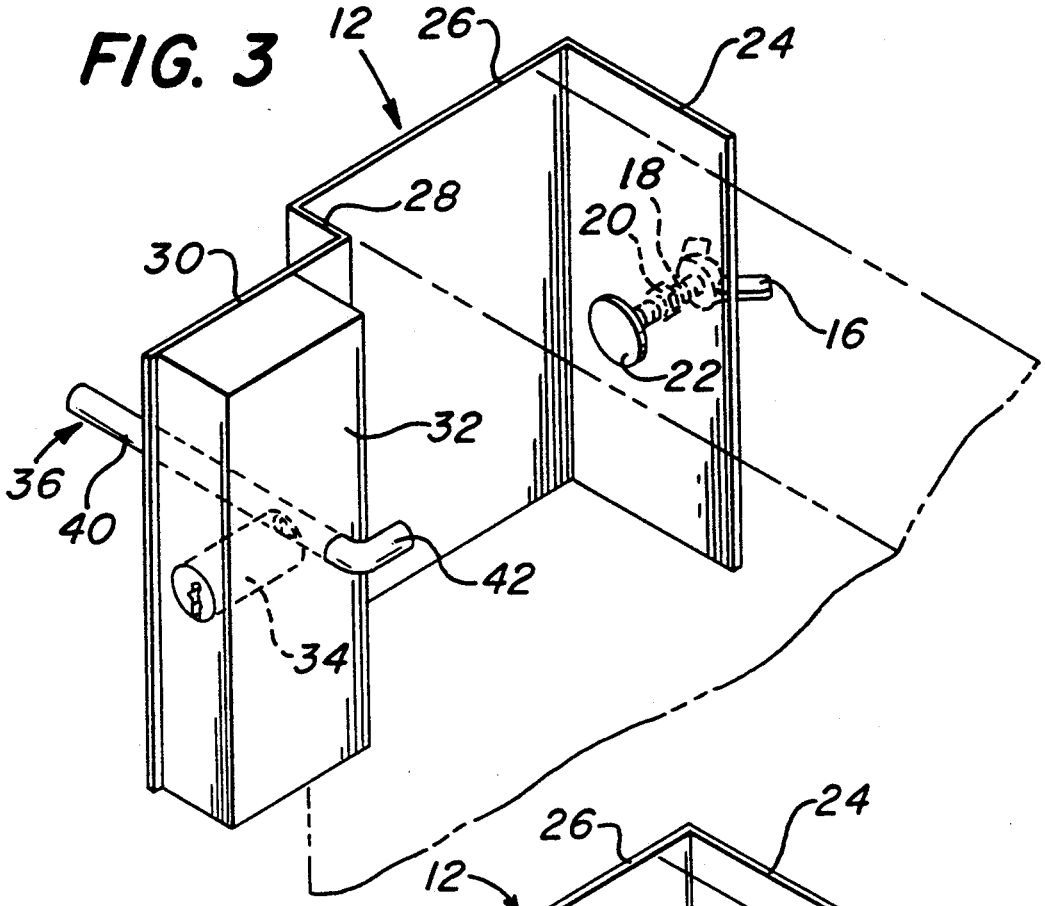
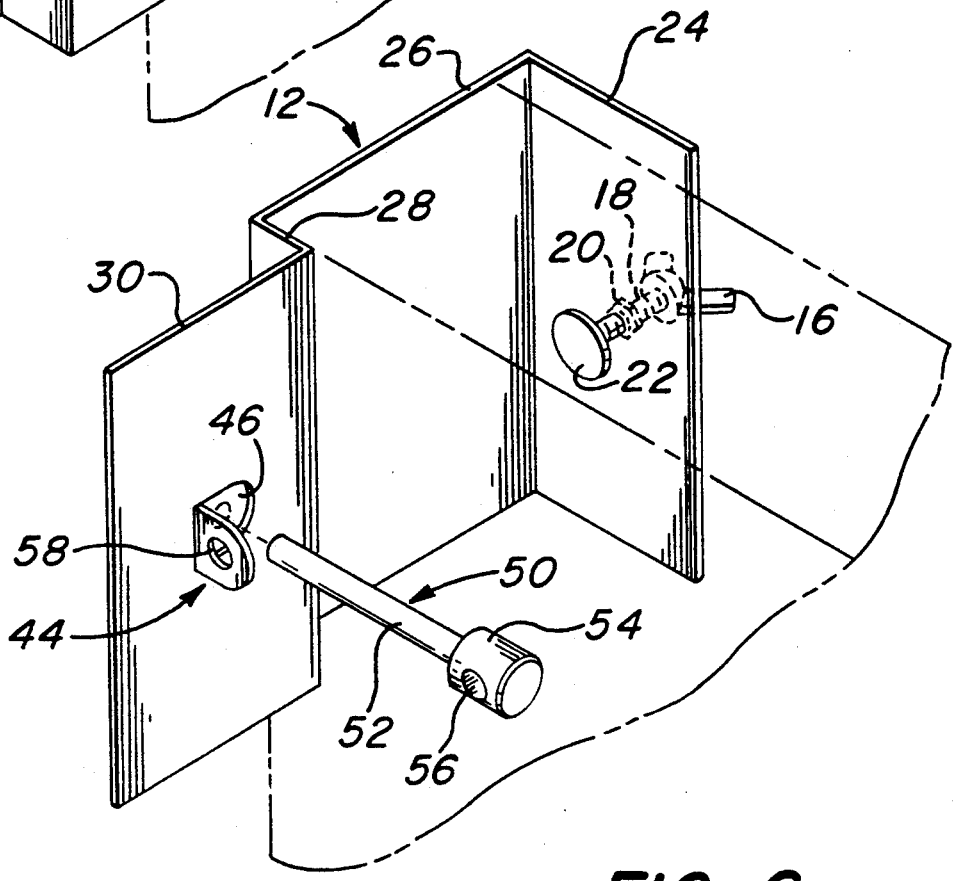
FIG. 6

FIG. 4
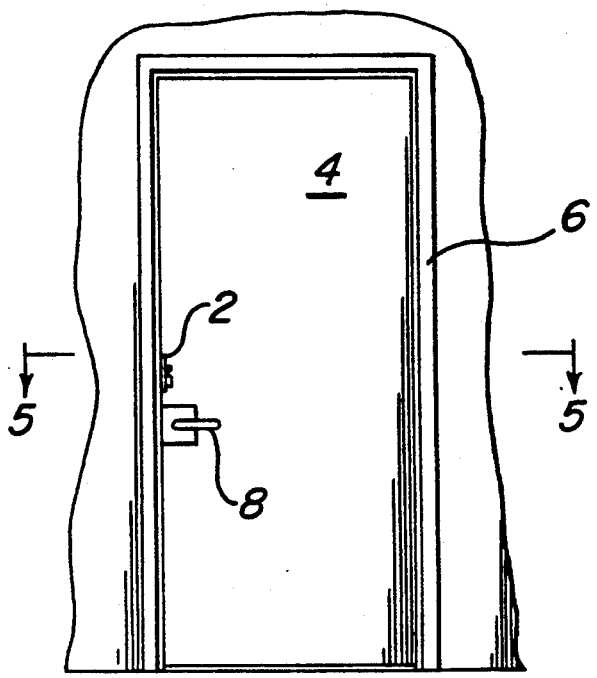
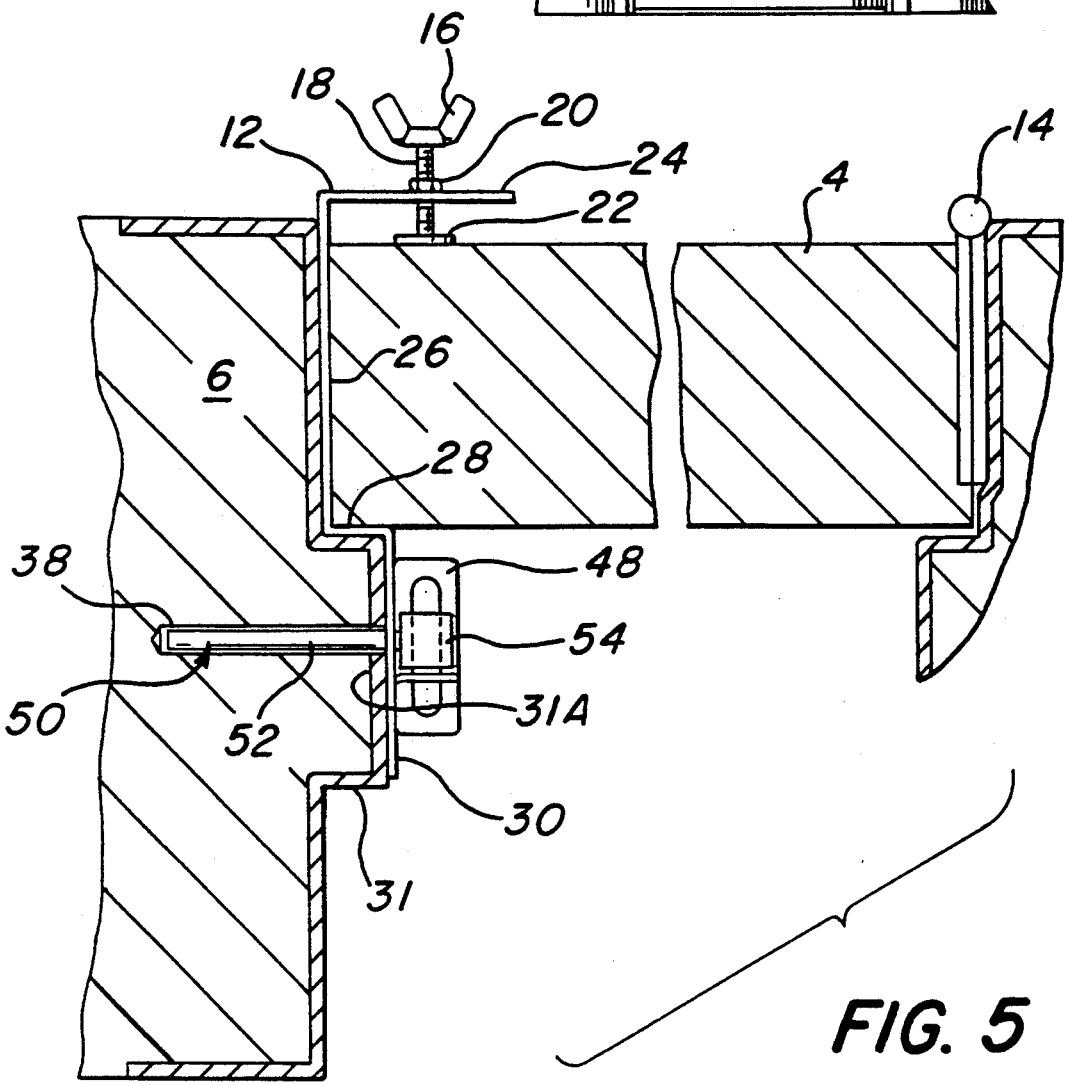
FIG. 5

LOCK FOR DOORS

BACKGROUND OF THE INVENTION

This invention generally relates to locks for doors and, more specifically, to a portable self-contained lock for doors.

Portable locks for doors are known. U.S. Pat. No. 4,399,672 (Moorhouse) discloses a removable auxiliary door lock which uses three different members, a door locking plate, a plate holding member, and a locking member which is pivotable.

U.S. Pat. No. 463,361 (Frazier) discloses a removable lock for doors which uses two plates with the inner plate thumb-screwed to the door and the outer plate secured to the inner plate using a lock.

U.S. Pat. No. 4,326,394 (Stein) discloses a removable lock for doors having three sections with padlocks either to lock the door from the inside or from the outside.

However, none of the existing portable locks for doors comprise a simple configuration using a unitary plate, which is completely self-contained, does not require the installation of any parts to the door or door frame, is completely independent of the existing door handle mechanism and keeper and can be rapidly attached and detached from the door without the use of any tools.

There is a particular need for an inexpensive portable locking device which can be rapidly and easily attached and detached from doors for places like hospitals, nursing homes, institutions and the like, wherein there can be no lock on the door with a patient occupying the room, to assure access at all times by nurses, aides, orderlies or doctors. On the other hand, when the room is unoccupied, there is a need to secure the room to protect its contents from misuse, damage, or theft.

OBJECTS OF THE INVENTION

Accordingly, it is the general object of the instant invention to provide a portable lock for doors which overcomes the shortcomings of present locks.

It is a further object of the instant invention to provide a portable lock for doors which can be attached and detached from doors manually without the requirement of tools.

It is still a further object of the instant invention to provide a portable lock for doors which utilizes a unitary plate and which is self-contained.

It is still yet a further object of the instant invention to provide a portable lock for doors which is installed independent of, and operates independently of, the existing door handle assembly and keeper.

It is another object of the instant invention to provide a portable lock for doors which is inexpensive to manufacture and easy to assemble and which can be easily and rapidly attached to and removed from doors.

SUMMARY OF THE INVENTION

These and other objects of the instant invention are achieved by providing a portable lock for doors which comprises a single unitary plate. The plate can be mounted to the back of the door using a simple wing nut with a threaded shaft and a flat disc which presses against the door. On the portion of the unitary plate which abuts the door frame, a peg, can be inserted into a hole in the door and locked into place using a key cylinder or padlock.

Thus, the locking mechanism can be rapidly removed from the door by first operating the key and removing the peg or opening and removing the padlock, then opening the door and rotating the wing nut to remove the entire device from the door.

DESCRIPTION OF THE DRAWING

Other objects and many of the intended advantages of this invention will be readily appreciated when the same becomes better understood by reference to the following detailed description when considered in connection with the accompanying drawing wherein:

FIG. 1 is a vertical view of a door upon which the lock of the instant invention has been installed.

FIG. 2 is an enlarged sectional view showing the lock of the instant invention installed in a door.

FIG. 3 is a perspective view of the lock of the instant invention.

FIG. 4 is a vertical view of a second embodiment of the instant invention installed in a door.

FIG. 5 an enlarged sectional view showing the second embodiment of the instant invention installed in a door.

FIG. 6 is a perspective view of the second embodiment of the instant invention.

DETAILED DESCRIPTION OF THE PREFERRED EMBODIMENT

Referring now in greater detail to the various figures of the drawing, wherein liked reference characters refer to like parts, there is shown in FIG. 1 a lock 2 of the instant invention installed in a door 4 which is set in door frame 6. It should be noted that the lock 2 is installed independently of door handle mechanism 8 and its keeper (not shown). Referring now to FIGS. 2 and 3, the lock 2 is installed in the door 4 on the side of the door 4 opposite the door hinge 14. The lock 2 comprises a unitary plate 12 which is attached to the inner side of the door 4 utilizing a wing nut 16. Wing nut 16 enables the manual rotation of threaded shaft 18 in retaining nut 20. Disc 22 abuts the door and as the wing nut 16 is rotated, the disc 22 presses against the door firmly holding the unitary plate 12 in place. First section 24 is parallel to the inner side of the door and has a hole therein for passage of the threaded shaft 18. The retaining nut 20 is attached to first section 24 to enable the threaded shaft 18 to be threaded through the retaining nut 20.

A second section 26 which is perpendicular to the first section 24 and which abuts the end of the door 4 opposite the hinge 14 is positioned between the door 4 and the door frame 6 when the door 4 is closed. Offset section 28 of the unitary plate 12 is perpendicular to the second section 26 and parallel to the first section 24. Of course, in an institution or hospital having a large plurality of common doors and door frames, the offset section 28 and the remainder of the unitary plate 12 can be sized to the common doors and frames.

A fourth section 30 abuts the jamb 31 of the door frame 6. It is parallel to the second section 26.

A lock assembly 32 is mounted on the fourth section 30 of the unitary plate 12. Lock cylinder 34 is emplaced in the lock assembly 32. As can be seen in FIGS. 2 and 3, a peg 36 comprising a rod 40 and a handle 42 is inserted through a hole in the lock assembly 32 and the fourth section 30 into an opening 38 in the door frame 6.

Operation of the lock cylinder 34 with its key, locks the peg 36 into place, or releases the peg 36 so that it can be removed from the opening 38 in the door frame 6.

A second embodiment of the instant invention will now be described. FIG. 4 shows the second embodiment of the portable lock 2 emplaced in the door 4 which is set in the door frame 6. Again, it should be noted that the lock assembly 2 is installed independently of the door handle assembly 8 and its associated keeper. The structure of the unitary plate 12 is the same as previously described in the first embodiment. Also, the attaching mechanism to the door 4 utilizing the threaded shaft 18, the wing nut 16, the retaining nut 20 and the disc 22 is the same as in the first embodiment.

However, here as can be seen in FIGS. 4, 5 and 6, a generally D-shaped bracket or ear 44 projects perpendicularly to the plane of the fourth section 30. The ear 44 is formed by being bent out of the plane of the section 30 so that a corresponding D-shaped opening 46 is formed in the section 30 at the foot of the ear 44. The opening 46 is arranged to be aligned with a hole 31A (FIG. 5) in the jamb 31. A peg 50 in the form of a rod 52 is provided to extend through the D-shaped opening 46, through the aligned hole 31A in the jamb 31, and into the opening 38 in the door frame 6. The peg 50 includes an enlarged handle or head 54 at one end. The head 54 includes a hole 56 extending diametrically therethrough. Thus, when the rod 52 is inserted through the aligned openings or holes 46 and 31A in the unitary plate and the jamb, respectively, so that it extends into the opening 38 of the door frame 6, the head 54 of the peg 50 will be adjacent the ear 44. The peg 50 can then be oriented about its longitudinal axis so that the hole 56 in its head 54 is axially aligned with a hole 58 in the ear 44.

The peg 50 may be locked into place using a padlock 48 (FIG. 5) with a key, a combination lock and/or a seal which if broken, would indicate tampering or removal, by placing the padlock or combination locks' tongue through the holes 56 and 58. Any standard type of seal (not shown) such as a wire whose ends are firmly connected to a retaining piece may be used.

A portable lock for doors has been described which is inexpensive and simple to manufacture and which can be rapidly attached or detached from doors manually, without the use of any tools. It uses a unitary plate and is self-contained so that it can be removed and stored when not in use.

Without further elaboration, the foregoing will so fully illustrate my invention that other may, by applying current or future knowledge, readily adapt the same for use under the various conditions of service.

I claim:

1. A portable lock assembly for a door mounted in a door frame, said lock assembly comprising:

(a) a unitary plate having a first section;

(b) a means for removably attaching and detaching said unitary plate from said door by hand only, without the use of tools, said attaching and detaching means comprises a wing nut attached to the proximal end of a threaded shaft and a disc attached to the distal end of said threaded shaft;

(c) a lock body mounted on said plate, said lock body comprising a lock cylinder and an opening for insertion of a peg through said lock body; and (d) a means in said door frame for accepting said peg, said means comprising a hole formed in said door frame.

2. The portable lock assembly of claim 1 wherein said unitary plate further comprises a second section connected to and perpendicular to said first section, a third section connected to and perpendicular to said second section and a fourth section connected to said third section and parallel to said second section.

3. The portable lock assembly of claim 2 wherein said lock body is mounted on said fourth section.

4. The portable lock assembly of claim 3 wherein said peg comprises a rod with a handle mounted on one end of said peg.

5. The portable lock assembly of claim 4 wherein said handle comprises a segment perpendicular to said rod.

6. A portable lock assembly for a door which is mounted in a door frame, said door frame having a hole therein, said lock assembly comprising:

(a) a unitary plate, said unitary plate comprises a first generally planar section, a second generally planar section, a third generally planar section, and a fourth generally planar section, said second section being connected to and perpendicular to said first section, said third section being connected to and perpendicular to said second section, and fourth section being connected to said third section and being parallel to said second section;

(b) a means for removably attaching and detaching said unitary plate from said door by hand only, without the use of tools, said attaching and detaching means comprising a rotatable shaft coupled to said first section and having a graspable portion and a distal end, said rotatable shaft arranged to be rotated by its graspable portion to cause said distal end to engage said door;

(c) a means for locking said door, said means comprising an ear on said unitary plate, a hole in said unitary plate adjacent said ear and aligned with said hole in said door frame, and a peg, said ear having a hole therein, said peg comprising an elongated member having a hole therein and being arranged to be extended through said aligned holes in said unitary plate and said door frame and with said hole in said peg being aligned with said hole in said ear.

7. The portable lock assembly of claim 6 additionally comprising a locking member extending through said hole in said peg and said hole in said ear.

8. A portable lock assembly for a door mounted in a door frame, said lock assembly comprising:

(a) a unitary plate;

(b) a means for attaching and detaching said unitary plate from said door by hand;

(c) a lock body mounted on said plate, said lock body comprising a lock cylinder and an opening for insertion of a peg through said lock body;

(d) a means in said frame for accepting said peg, said means comprising an opening in said frame; and wherein said unitary plate comprises a first section and said attaching and detaching means comprises a wing nut attached to the proximal end of a threaded shaft and a disc attached to the distal end of said threaded shaft.

9. The portable lock assembly of claim 8 wherein said unitary plate further comprises a second section connected to and perpendicular to said first section, a third section connected to and perpendicular to said second section and a fourth section connected to said third section and parallel to said second section.

10. The portable lock assembly of claim 9 wherein said lock body is mounted on said fourth section.

11. The portable lock assembly of claim 10 wherein said peg comprises a rod with a handle mounted on one end of said rod.

12. The portable lock assembly of claim 11 wherein said handle comprises a segment perpendicular to said rod.

13. A portable lock assembly for a door which is mounted in a door frame, said lock assembly comprising:

(a) a unitary plate;

(b) a means for attaching and detaching said unitary plate from said door by hand;

(c) a means for locking said door, said means comprising a hole in said unitary plate, a peg, and an opening in said door frame; and wherein said unitary plate comprises a first section and said attaching and detaching means comprises a wing nut attached to the proximal end of a threaded shaft and a disc attached to the distal end of said threaded shaft;

wherein said unitary plate further comprises a second section connected to and perpendicular to said first section, a third section connected to and perpendicular to said second section, and a fourth section connected to said third section and parallel to said second section; and wherein said locking means further comprises an ear connected to said fourth section adjacent said hole in said unitary plate and extending perpendicularly to said fourth section.

14. The portable lock assembly of claim 13 wherein said peg comprises a rod and a locking member connected to one end of said rod and to said ear.

* * * * *